US011919069B2

(12) United States Patent
Lorenz et al.

(10) Patent No.: US 11,919,069 B2
(45) Date of Patent: Mar. 5, 2024

(54) DRIVE DEVICE FOR A STOPPER FOR A METALLURGICAL VESSEL

(71) Applicant: Refractory Intellectual Property GmbH & Co. KG, Vienna (AT)

(72) Inventors: Roland Lorenz, Root (CH); Erich Rollin, Menzingen (CH)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 69 days.

(21) Appl. No.: 17/753,090

(22) PCT Filed: Jul. 3, 2020

(86) PCT No.: PCT/EP2020/068883
§ 371 (c)(1),
(2) Date: Feb. 18, 2022

(87) PCT Pub. No.: WO2021/032354
PCT Pub. Date: Feb. 25, 2021

(65) Prior Publication Data

US 2022/0274161 A1 Sep. 1, 2022

(30) Foreign Application Priority Data

Aug. 20, 2019 (EP) ..... 19192630

(51) Int. Cl.
*B22D 41/20* (2006.01)
*B22D 11/103* (2006.01)

(52) U.S. Cl.
CPC ..... *B22D 41/20* (2013.01); *B22D 11/103* (2013.01)

(58) Field of Classification Search
CPC ..... B22D 41/20; B22D 11/103
See application file for complete search history.

(56) References Cited

U.S. PATENT DOCUMENTS

| | | | | |
|---|---|---|---|---|
| 4,953,761 | A * | 9/1990 | Fishman | B22D 41/20 222/602 |
| 5,333,764 | A * | 8/1994 | Kassuba | B22D 41/20 222/602 |
| 5,674,426 | A | 10/1997 | Schmid et al. | |
| 6,960,317 | B2 | 11/2005 | Dussud et al. | |
| 8,701,948 | B2 * | 4/2014 | Paiva | B22D 41/20 222/602 |
| 10,024,455 | B2 | 7/2018 | De Luca et al. | |
| 2022/0274161 | A1 * | 9/2022 | Lorenz | B22D 41/20 |

FOREIGN PATENT DOCUMENTS

| | | |
|---|---|---|
| EP | 0734801 A1 | 10/1996 |
| EP | 2916979 B1 | 2/2017 |
| WO | 2021032354 A1 | 2/2021 |

* cited by examiner

*Primary Examiner* — Scott R Kastler
(74) *Attorney, Agent, or Firm* — Brian Roffe

(57) ABSTRACT

Drive device for a stopper closure on a metallurgical vessel, including a housing arranged on the vessel in a removable manner, an adjustment system mounted in the housing so as to be height-displaceable and has a drive which can be coupled to the housing, and an upper connection element for a support arm carrying the fire-proof stopper. The adjustment system for the stopper is mounted so as to be height-displaceable on at least one bearing shaft fastened in the housing. This design of the adjustment system permits an increase in the stiffness of the drive device and hence of the fire-proof stopper suspended by the drive device on the support arm during pouring.

20 Claims, 3 Drawing Sheets

DRIVE DEVICE FOR A STOPPER FOR A METALLURGICAL VESSEL

FIELD OF THE INVENTION

The invention relates to a drive device for a stopper closure on a metallurgical vessel in accordance with a removable housing arranged on the vessel, a height-displaceable adjustment means mounted in the housing, a drive which can be coupled to the height-displaceable adjustment means, and an upper connection element for a support arm holding a fire-proof stopper.

BACKGROUND OF THE INVENTION

A drive device in accordance with the printed publication EP 1 426 126, which is considered to correspond to U.S. Pat. No. 6,960,317, with a control unit for controlling a stopper for regulating the flowing steel melts from a spout of a vessel of a continuous casting plant comprises a guide assembly, a drive shaft for driving the stopper, a motor, and means which are suitable for converting the rotational movement of the motor into a translational movement of the drive shaft. In this situation, the motor is arranged in a detachable manner on the under side of the drive shaft, and, on the upper side, this drive shaft projects out of a cylindrical housing of the guide assembly, and a support arm can be secured to this for holding the stopper. Disadvantageous with this arrangement of the drive device is that its drive shaft projects upwards out of the housing, and, due to the bending movements caused by the stopper and the support arm connected to it, imprecisions can occur in relation to the position of the stopper, and therefore deviations in the controlling of the quantity of the melt during casting.

OBJECTS AND SUMMARY OF THE INVENTION

Taking this as a basis, the invention is based on the object of further developing a drive device for a stopper closure in such a way that, with this, increased stability and stiffness can be achieved, and therefore precise metering during casting. In addition to this, it is intended that user-friendliness should be improved in respect of installation and manipulation of the stopper.

This object is solved according to the invention in that these adjustment means for the stopper are mounted in a height-displaceable manner on at least one bearing shaft secured in the housing.

With this configuration of the adjustment means according to the invention, an increase in the stiffness of the drive device can be achieved, and therefore of the fire-proof or metallic stopper suspended on the support arm during casting.

In order to maximize this, provision is made for the adjustment means to comprise at least one upper bearing and, spaced at a distance from this, a lower bearing, guided in each case on the bearing shaft, as well as a sleeve element connecting them.

BRIEF DESCRIPTION OF THE DRAWINGS

The invention and its further advantages are explained in greater detail hereinafter on the basis of exemplary embodiments and by reference to the Figures. The Figures show.

DETAILED DESCRIPTION OF THE INVENTION

Figure 1:
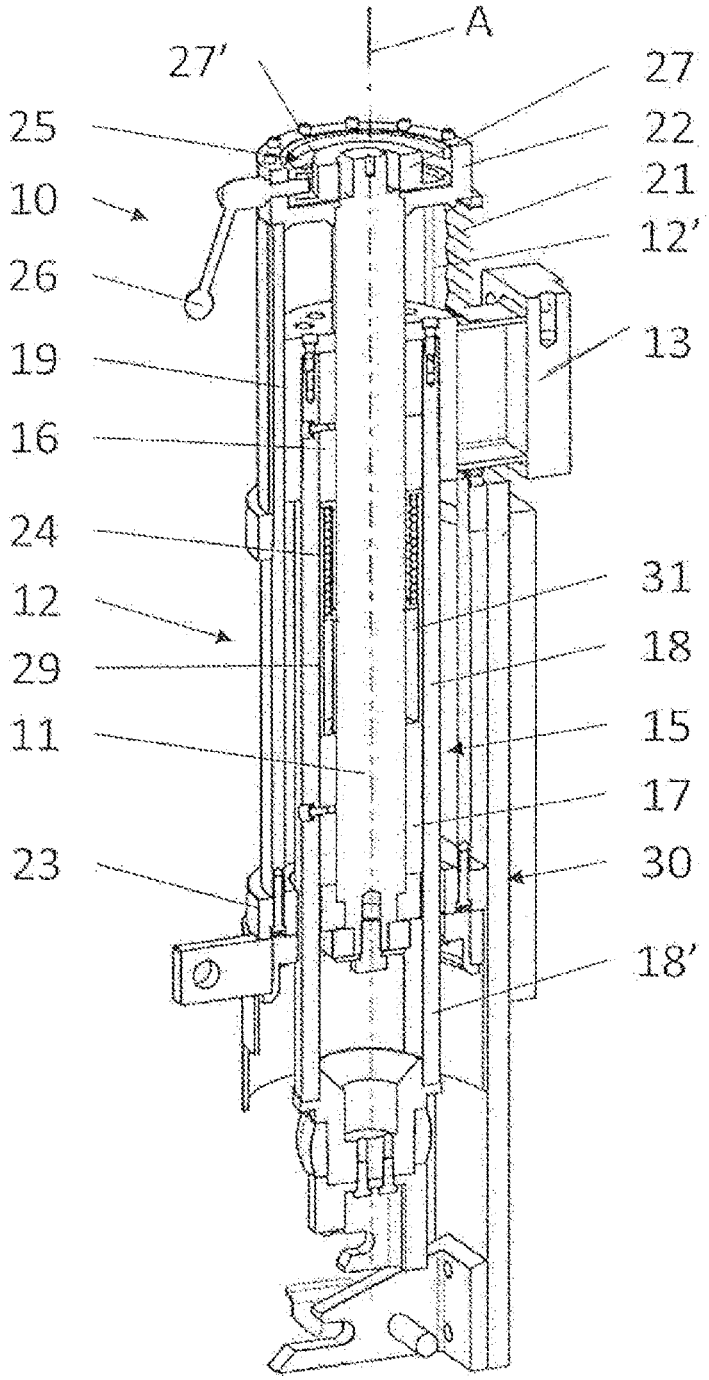
FIG. 1 is a perspective longitudinal section of the drive device according to the invention, without a support arm and without the base plate which can be secured to the vessel.

FIG. 1 shows a drive device 10 for a stopper closure on a metallurgical vessel, which is explained in greater detail hereinafter. This drive device 10 comprises a housing 12 which can be mounted on the vessel, an adjustment means 15 mounted on this so as to be height-displaceable, with a drive 14 which can be coupled to it, and an upper connection element 13 for a support arm holding the fire-proof or metallic stopper. Both the axis A of the adjustment device of the drive device 10 and also the stopper are normally aligned vertically.

According to the invention, the adjustment means 15 are mounted in a height-displaceable manner on at least one bearing shaft 11, secured in the housing 12. This makes it possible for this height-displaceable means 15 to be located in any operational position inside the housing 12, and therefore allows for an extremely stiff holding of the stopper held by the support arm.

The measure of assigning to the adjustment means 15 an upper bearing and a lower bearing 16, 17, spaced apart and with the lower bearing being guided in each case on the bearing shaft 11, as well as a sleeve element 18 connecting them, provides additional support for the increasing of the stiffness of the drive device 10 which is being striven for. The distance interval between the upper and lower bearings 16, 17 is adjusted to the possible length of the housing 12 on the basis of the dimensions of the vessel height, or maximized respectively. The bearings 16, 17 are advantageously configured as linear ball bearings, sliding bearings, and/or the like.

The upper bearing 16 is surrounded by the sleeve element 18, and this is surrounded by a head piece 19 of the adjustment means 15, which moves in the interior of the tubular-shaped housing 12. The housing 12 is provided in the upper region with a sealable side opening 12', through which the connection element 13, connected to the head piece 19, projects, and which is located outside the housing. The stroke movement of the adjustment means 15, and accordingly the height of the side opening 12', are dimensioned as somewhat longer than the predetermined maximum stroke of the stopper closure. The opening 12' is also closed by a folding seal 21, in order to protect the interior of the housing 12 with the bearings 16, 17 against dirt particles, such as dust. These bearings 16, 17 are additionally protected by dirt scrapers, not shown in greater detail.

Within the framework of the invention, the bearing shaft 11 is secured with its ends in the tubular-shaped housing 12 in each case by a cover 22, 23, and in this situation, it extends in the coaxial alignment to this housing 12 as far as its upper and lower ends respectively. It, and with it, the upper bearing 16 and the support arm secured to the connection element 13, are mounted such as to be pivotable about the shaft axis A. Accordingly, before being taken into operation, the stopper can be precisely centred on the run-out sleeve which corresponds to it. In order to increase the stability, the connection element 13 for the support arm is arranged at least close to the upper bearing 16.

Contained in the cover 22, at the upper end of the housing 12, is a manually-operated brake 25, by means of which this pivoting of the bearing shaft 11, and therefore of the support arm, about the shaft axis A can be released or blocked. The connection between the adjustment means 15 and the connection element 13 to the support arm 43 is not detached in this situation. This therefore ensures the operational safety and user-friendliness. A disk 27, which can rotate in the cover 22, is rotationally connected to the bearing shaft 11, which is shaped at its outer periphery as a circulating track 27', interacting with a rotatable lever 26. This lever 26, on the upper side of the housing 12 allows for optimum access for the operating personnel.

The sleeve element 18 is located at a distance radially to the bearing shaft 11, between the upper and the lower bearing 16, 17, and there forms a ring-shaped chamber 31, contained in which, above one another, are a spring element 24 and a spacer ring 29. As this spring element 24, use is made preferably of a pressure spring, which, at a downwards movement of the adjustment means 15, is compressed by the upper bearing 16, and therefore makes a weight compensation possible, by means of which the stopper, in the operational state, can be moved upwards with little force expenditure.

Figure 2:
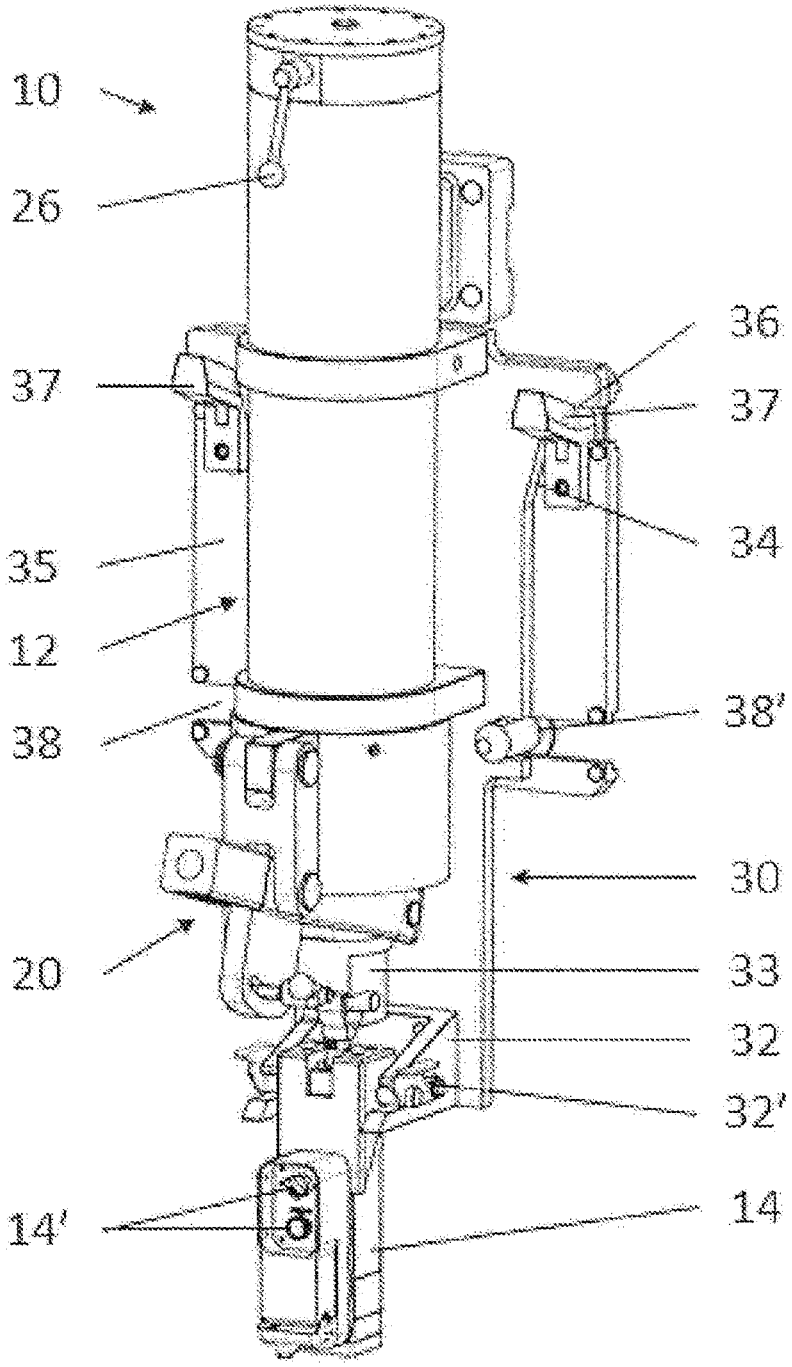
FIG. 2 is a perspective view of the drive device according to FIG. 1 with support arm and base plate.

According to FIG. 2, provided at the lower end of the housing 12 is a drive 14 for raising and lowering the adjustment means 15, in particular for automated and also manual operation of the stopper closure during casting. This drive 14 can be coupled to a coupling element 32, with an actuatable locking lever 32' on an associated mounting plate 30, and is therefore easily accessible for the operating personnel during the casting. This drive 14 advantageously functions electromechanically as a linear drive, but could also be configured as a hydraulic piston/cylinder unit. The corresponding switching buttons 14' for operation are located on the drive 14.

Assigned to the lower end of the sleeve element 18 of the adjustment means 15 are connecting elements 18', projecting through the lower cover 23 of the housing 12, which comprise a coupling element 33, located beneath the housing 12, for a detachable connection to a lifting rod of the drive 14. In addition, attached by a jointed connection to this coupling element 33 is a lifting linkage 20, indicated in outline, for the manual raising and lowering of the adjustment means 15, and therefore of the stopper.

This mounting plate 30, arranged at the housing 12 laterally in its longitudinal extension, can be suspended self-centring in a base plate 35, which can be fixed to the vessel. to the purpose, arranged at the base plate 35 are two sliding blocks 37, spaced apart from one another and projecting obliquely upwards, between which the mounting plate 30 is positioned with its lateral centring surfaces 34, and can be supported on the contact surfaces 36, such that the drive device 10, with the housing 12, can be mounted in a simple manner on the vessel, and taken away from it. In addition, arranged beneath the sliding blocks 37 are lateral cut-out openings 38 in the mounting plate 30, and bolts 38' projecting through these, on the base plate 35 at the vessel, by means of which an additional positioning of the mounting on the base plate can be achieved.

Figure 3:
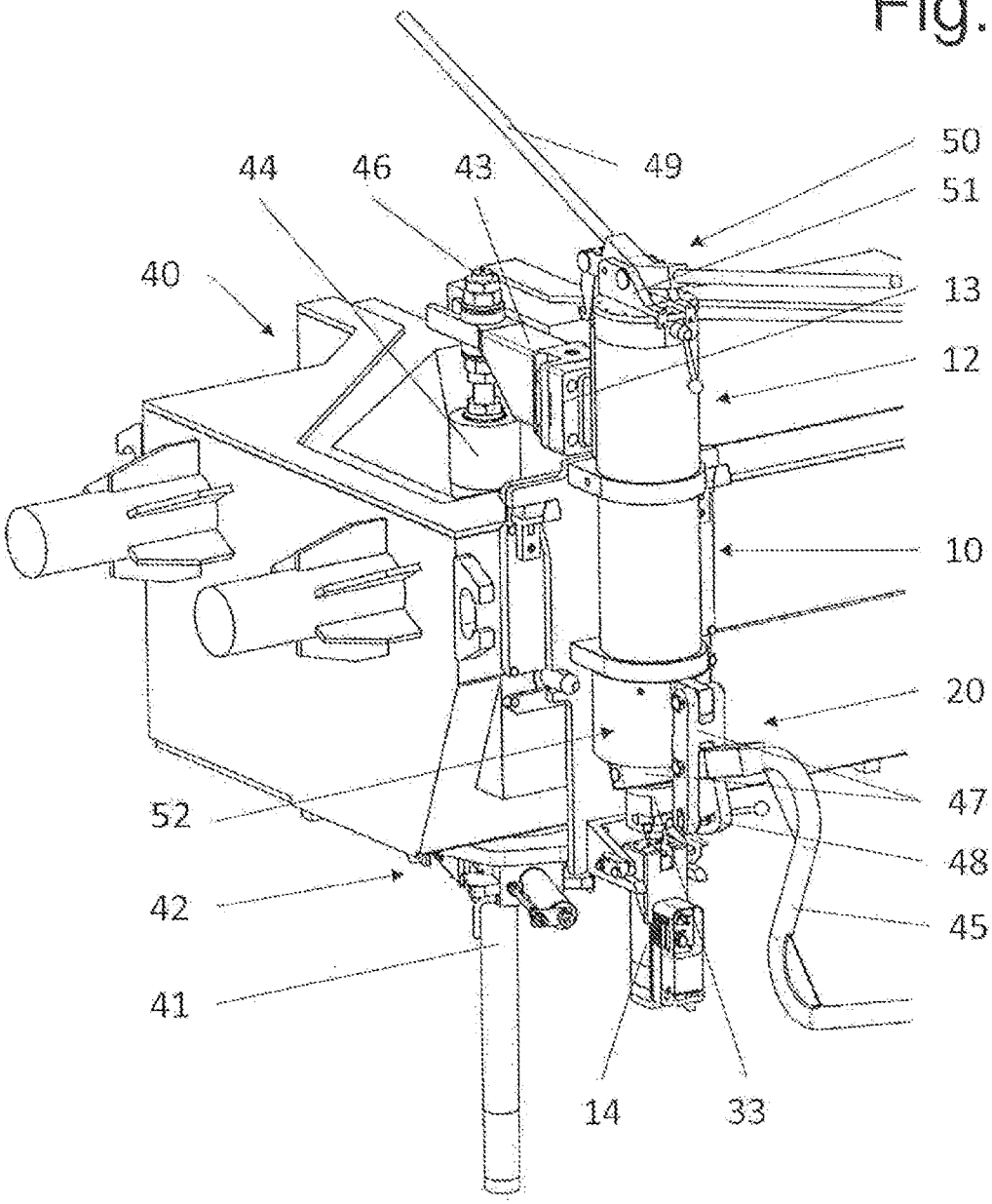
FIG. 3 is a perspective view of the drive device mounted on a vessel according to FIG. 1 with support arm and a stopper on the arm.

FIG. 3 shows the drive device 10 at a partially represented vessel 40, which is used as what is referred to as a tundish in a continuous casting plant, and with which the melts with which it has been filled are conveyed in a known manner through a refractory or partially metallic immersion pipe 41 of a changeover device 42, into a mould, not shown in any greater detail. The vessel can likewise be a ladle, or a vessel or furnace, containing any desired form of metal melts. The tundish will not be described in any greater detail hereinafter, since, as mentioned, this is inherently known.

In relation to FIG. 2, in addition, the support arm 43 is shown, secured to the connection element 13 of the drive device 10, and the refractory stopper 44, held at the front of this by securing means 46.

Furthermore, this lever linkage 20 for the manual raising and lowering of the adjustment means 15, and therefore of the stopper 44, is also shown. This consists of reversing levers 47, which are joint-connected to the coupling element 33 of the adjustments means 15, and which are rotatably connected to a longer hand lever 45, which can be removed when casting is being carried out in an automatically controlled manner with the drive 14. These reversing levers 47 are also operationally connected to a locking brake 48, in order to hold the adjustment means 15 in a desired position. This manually operated hand lever 45 on the underside of the vessel 40 provides the advantage that the operator has visual contact with the mould. Also arranged beneath the housing 12 is a removable cover sleeve 52.

In addition to this, provided on the upper side of the housing 12 is a fixed or removable adjustment device 50, with a holding element 51, and at least one manually operated lever 49, which can be connected to the connection element 13 or the support arm 43 of the adjustment means 15, and by means of which the operator, standing on the upper side or to the side of the vessel 40, can raise or lower the support arm 43, and therefore the stopper 44, along the vertical axis A.

Likewise preferably on the upper side of the housing 12 is a fixed or removable holding element, such as a tab or link plate, which can be used for the transport of the drive device 10. This means that no forces or flexure torque moments are incurred on the bearings or on the adjustment means during transporting.

The invention could of course also be explained by other exemplary embodiments. For example, instead of a bearing shaft, it would also be possible for two or more shafts to be arranged next to one another and for correspondingly configured bearings to be provided. The bearing shaft could also be provided with another cross-section instead of circular, such as quadratic, rectangular, polygonal, or the like. In addition, the sleeve element could be configured as a cage, struts, and/or the like, and the connection element could be configured as two-part or multi-part, or another form than that represented.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. Drive device for a stopper on a metallurgical vessel, comprising:

a removable housing configured to be arranged on the vessel, height-displaceable adjustment means mounted in the housing for adjusting a height of the stopper relative to a spout of the vessel when the housing is arranged on the vessel, a drive configured to be coupled to the adjustment means to move the adjustment means, an upper connection element configured to connect to a support arm holding the stopper, the upper connection element being moved by the adjustment means, and at least one bearing shaft secured in the housing, the adjustment means being mounted on the at least one bearing shaft.

2. Drive device according to claim 1, wherein the adjustment means comprises at least one upper bearing and one lower bearing spaced apart from one another and guided on the at least one bearing shaft, and a sleeve element connecting the at least one upper bearing and the lower bearing.

3. Drive device according to claim 2, wherein the at least one upper bearing of the adjustment means is configured with a head piece or is surrounded by a head piece, which additionally is guided in an interior of the housing, and wherein the upper connection element for the support arm is arranged above the at least one upper bearing.

4. Drive device according to claim 2, wherein the housing is tubular and is provided with a sealable side opening through which the upper connection element, connected to the at least one upper bearing, projects and which is located outside the housing.

5. Drive device according to claim 1, wherein the at least one bearing shaft is secured at its ends in the housing by a respective cover and extends in a coaxial alignment to an upper end of the housing.

6. Drive device according to claim 2, wherein the sleeve element connecting the at least one upper bearing to the lower bearing is located radially spaced away from the at least one bearing shaft, and forms therein a ring-shaped chamber, contained in which is a spring element for weight compensation, by means of which the stopper, in the operational state, is movable upwards.

7. Drive device according to claim 1, wherein the drive is configured to move the adjustment means by raising and lowering the adjustment means and therefore the stopper which is coupled to the adjustment means by the support arm, the drive being coupled to a lower end of the housing.

8. Drive device according to claim 1, wherein the adjustment means comprises a coupling element, projecting out of the housing, for a detachable connection to the drive, and is joint-connected to a lever linkage for manual actuation.

9. Drive device according to claim 2, wherein the at least one bearing shaft and the at least one upper bearing and the support arm, secured to the upper connection element, are configured to be pivotable about an axis, further comprising a brake at an upper end of the housing that releases or blocks pivoting of the at least one bearing shaft and the support arm about the axis.

10. Drive device according to claim 1, further comprising:

a base plate configured to be fixed to the vessel, and a mounting plate at the housing, running laterally in a longitudinal extension, which is configured such that the mounting plate, with the housing, is configured to be suspended in a self-centering manner on the base plate, which in turn is configured to be fixed to the vessel.

11. Drive device according to claim 10, further comprising two sliding blocks arranged on the base plate, the two sliding blocks being spaced apart from one another and projecting obliquely upwards, the mounting plate being supported on or between the two sliding blocks by standing or centering surfaces, such that the housing has a position mounted on the vessel and another position removed from the housing.

12. Drive device according to claim 1, further comprising a fixed or removable adjustment device on an upper side of the housing, the adjustment device including a holding element, and at least one manually-operated lever connectable to the upper connection element or the support arm of the adjustment means, and by means of which the support arm and the stopper are raised and lowered along an axis.

13. Drive device according to claim 1, further comprising a fixed or removable holding element on an upper side of the housing for transport of the drive device.

14. Drive device according to claim 1, wherein the adjustment means are configured to be positioned by the drive in a plurality of operational positions inside the housing.

15. Drive device according to claim 1, wherein the adjustment means comprise a head piece that moves in an interior of said housing.

16. Drive device according to claim 15, wherein the housing includes a side opening on a circumferential side below an upper end of the housing, the upper connection element extending through the side opening into engagement with the head piece.

17. Drive device according to claim 1, wherein the adjustment means are movable upward and downward within an interior of said housing and their upward movement is limited to a position inside the housing.

18. Drive device according to claim 15, wherein the adjustment means comprise upper and lower bearings spaced apart from one another, a sleeve element connecting the upper and lower bearings and being situated partly around the upper bearing, the head piece being situated around the sleeve element.

19. Drive device according to claim 1, wherein the adjustment means are situated radially outward of the at least one bearing shaft.

20. Drive device according to claim 1, wherein the at least one bearing shaft has ends and is secured in the housing with its ends inside the housing.

* * * * *